US005685284A

United States Patent [19]

Nakamichi

[11] Patent Number: 5,685,284

[45] Date of Patent: Nov. 11, 1997

[54] $O^2$-SENSOR FAULT DIAGNOSIS METHOD AND APPARATUS

[75] Inventor: Masaki Nakamichi, Tokyo, Japan

[73] Assignee: Mitsubishi Denki Kabushiki Kaisha, Tokyo, Japan

[21] Appl. No.: 615,411

[22] Filed: Mar. 14, 1996

[30] Foreign Application Priority Data

Jun. 8, 1995 [JP] Japan ..... 7-142036

[51] Int. Cl.[6] ..... F02D 41/00

[52] U.S. Cl. ..... 123/688

[58] Field of Search ..... 123/688, 481, 123/479, 691, 703; 60/276; 73/118.1; 340/438; 364/431.05

[56] References Cited

U.S. PATENT DOCUMENTS

| | | | |
|---|---|---|---|
| 5,209,206 | 5/1993 | Danno et al. | 123/479 |
| 5,224,461 | 7/1993 | Nakaniwa | 123/688 |
| 5,243,954 | 9/1993 | Moss | 123/688 |
| 5,247,793 | 9/1993 | Yamada et al. | 60/276 |
| 5,379,635 | 1/1995 | Gee et al. | 73/118.1 |
| 5,505,183 | 4/1996 | Sinha et al. | 123/688 |
| 5,526,793 | 6/1996 | Johansson | 123/481 |

FOREIGN PATENT DOCUMENTS

| | | | |
|---|---|---|---|
| 57-137633 | 8/1982 | Japan . | |
| 2011840 | 1/1990 | Japan | 123/688 |
| 5099044 | 4/1993 | Japan | 123/688 |
| 6074074 | 3/1994 | Japan | 123/688 |

*Primary Examiner*—Raymond A. Nelli

*Attorney, Agent, or Firm*—Sughrue, Mion, Zinn, Macpeak & Seas, PLLC

[57] ABSTRACT

An $O_2$-sensor fault diagnosis method and apparatus for detecting a fault of an $O_2$-sensor when a feedback control of a fuel supply to an engine is performed by making use of the output of an $O_2$-sensor and detecting and identifying a fault of the $O_2$-sensor even in the case where the feedback control is invalidated. A microcomputer (24) receives an output of an $O_2$-sensor (19) for detecting concentration of oxygen contained in an exhaust gas of an internal combustion engine (1). An ECU (20) controls a quantity of fuel supplied to the internal combustion engine (1) through feedback control in dependence on an output signal of the $O_2$-sensor (19). A first decision circuit is provided for deciding whether or not the $O_2$-sensor (19) exhibits abnormality on the basis of the output signal state of the $O_2$-sensor (19) by forcibly changing the amount of the fuel supplied to the engine during the feedback control, and a second decision circuit is provided for deciding abnormality of the $O_2$-sensor (19) in accordance with an abnormality decision process which bears a stronger correlation to the abnormality than the decision performed by the first decision circuit. Fault detection of the $O_2$-sensor is possible not only during the feedback control of the fuel supply but also in the state where the feedback control is not performed.

7 Claims, 6 Drawing Sheets

$O^2$-SENSOR FAULT DIAGNOSIS METHOD AND APPARATUS

BACKGROUND OF THE INVENTION

1. Field of the Invention

The present invention relates to a fault diagnosis method and apparatus for an $O_2$-sensor employed in a fuel supply control system of an internal combustion engine which is employed in a feedback control of a fuel supply to an internal combustion engine for determining whether or not the $O_2$-sensor suffers abnormality.

2. Description of Related Art

It is known that the output characteristic of an $O_2$-sensor employed for an air-fuel ratio control in an internal combustion engine undergoes variation as time lapses, as described in Japanese Unexamined Patent Application Publication No. 137633/1982 (JP-A-57-137633). Accordingly, if no measures are taken to cope with such time-dependent variation of the characteristic of the $O_2$-sensor, the performance of the internal combustion engine may deteriorate. Particularly, the gas mileage may drop and pollutant discharge may increase. Under the circumstances, a variety of $O_2$-sensor fault diagnosis apparatuses have heretofore been developed and widely employed.

A conventional $O_2$-sensor fault diagnosis techniques is disclosed in Japanese Unexamined Patent Application Publication No. 11840/1990 (JP-A-2-11840), according to which diagnosis of a fault of an $O_2$-sensor is made on the basis of an output response time of the $O_2$-sensor when controlling forcibly an amount of fuel supplied to the engine periodically at a predetermined time interval with a predetermined magnitude in the course of a feedback control of the fuel supply to the engine in a steady running state thereof.

However, with the $O_2$-sensor fault diagnosis apparatus of the known structure mentioned above, a great difficulty will be encountered in detecting deterioration of the $O_2$-sensor when the sensor is in such a faulty state which makes it impossible to perform proper feedback control by using the $O_2$-sensor (e.g. deterioration of the sensor causing the output voltage thereof to shift constantly toward indication of richness or leanness). Besides, it is difficult to detect with accuracy and reliability a fault of the $O_2$-sensor due to injury thereof or due to abnormality of an output signal line thereof (e.g. wire breaking or groundfault).

SUMMARY OF THE INVENTION

In the light of the state of the art described above, it is an object of the present invention to provide an $O_2$-sensor fault diagnosis method which is capable of detecting a fault of an $O_2$-sensor during a feedback control using the output of the $O_2$-sensor, and which is capable of detecting and identifying a fault of the $O_2$-sensor even in the case where the feedback control is not effectuated.

Another object of the present invention is to provide an $O_2$-sensor fault diagnosis apparatus for carrying out the method mentioned above.

In view of the above and other objects which will become apparent as the description proceeds, there is provided according to a general aspect of the present invention an $O_2$-sensor fault diagnosis apparatus which includes an $O_2$-sensor for detecting concentration of oxygen (hereinafter referred to as the oxygen concentration) contained in an exhaust gas of an internal combustion engine, a feedback control for controlling the quantity of fuel supplied to the internal combustion engine in dependence on the output signal of the $O_2$-sensor, a first decision means for deciding whether or not the $O_2$-sensor exhibits abnormality on the basis of the output signal state of the $O_2$-sensor by forcibly changing the amount of the fuel supplied to the engine during the feedback control, and a second decision means for deciding abnormality of the $O_2$-sensor an accordance with an abnormality decision process which bears a stronger correlation to the abnormality than the decision performed by the first decision means.

By virtue of the arrangement described above, the fault diagnosis can be performed at an earlier stage after the start of engine operation over a wide range which covers a fault of the $O_2$-sensor itself and a failure in the output line or wiring thereof such as wire breaking and ground-fault which makes the feedback control impossible as well as deterioration of performance of the $O_2$-sensor which incurs degradation of the accuracy in the air-fuel ratio control even when the feedback control is possible.

In a preferred mode for carrying out the invention, the second decision means may be put into operation when the feedback control based on the output of the $O_2$-sensor is not being performed.

In another preferred mode for carrying out the invention, the second decision means mentioned above may include an input resistance changing means for changing an input resistance for the $O_2$-sensor feedback control means.

Owing to the arrangement described above, the ground-fault or wire bearing of the output line of the $O_2$-sensor which makes it impossible to feed back the output of the $O_2$-sensor can easily and discriminatively be determined by detecting the voltage level across the input resistor.

In a further preferred mode for carrying out the invention, the input resistance changing means may include an input circuit disposed between output of the $O_2$-sensor and the second decision means constituted by a microcomputer. The input circuit includes an analogue-to-digital converter having an input connected to the output of the $O_2$-sensor and an output connected to an input port of the microcomputer, an input resistor connected to an input terminal of the analogue-to-digital converter, a switching element connected between the other end of the input resistor and the ground potential. A junction between the input resistor and the switching element is connected to the ground potential by way of a resistor and a voltage source. An ON/OFF control signal is applied from the microcomputer to the switching element to thereby correspondingly change resistance of the input circuit.

In conjunction with the above-mentioned arrangement, the input resistance changing means may preferably be so implemented as to present a high input resistance to the $O_2$-sensor feedback control means when the feedback control is being performed, and applies a predetermined voltage to one end of an input resistor for the feedback control means upon decision of abnormality.

Due to the arrangement described above, abnormality which the $O_2$-sensor suffers can easily be identified because of appearance of the predetermined voltage in the feedback control means Upon breaking or ground-fault of the output line or wire of the $O_2$-sensor.

According to another general aspect of the present invention, there is provided a fault diagnosis method for an $O_2$-sensor employed in a fuel supply control system of an internal combustion engine which includes a combination of a first method of varying forcibly an amount of fuel supplied to the internal combustion engine during a feedback control of the fuel supply to the engine in dependence on an output signal supplied from an $O_2$-sensor for detecting concentration of oxygen contained in an exhaust gas of an internal combustion engine, to thereby decide whether the $O_2$-sensor suffers abnormality on the basis of the output signal state of the $O_2$-sensor and a second method of making decision as to abnormality of the $O_2$-sensor in accordance with a decision method which bears a stronger correlation to the abnormality of the $O_2$-sensor.

With the arrangement described above, such abnormality of the $O_2$-sensor which can not be diagnosed with definite distinction when the feedback control is being performed can be decided with high reliability.

Preferably, the second mentioned method bearing stronger correlation to the abnormality should be carried out when the feedback control of the fuel supply to the engine is not performed.

The above arrangement is advantageous in that the fault of the $O_2$-sensor such as ground-fault or wire breaking of the output line of the $O_2$-sensor which can not be identified during the feedback control can discriminatively be detected definitely and distinctively from abnormality such as deterioration of the characteristics of the $O_2$-sensor which is difficult to detect when the feedback control is not being effected.

In a preferred mode for carrying out the invention, $O_2$-sensor fault diagnosis methods mentioned above, a voltage signal having different levels in dependence on ground-fault or wire breaking of an output line of the $O_2$-sensor should preferably be generated for the feedback loop.

With the arrangement described just above, the ground-fault or wire breaking of the outline of the $O_2$-sensor can discriminatively be detected with high accuracy.

In conjunction with the $O_2$-sensor fault diagnosis method mentioned just above, it is preferred to effectuate the abnormality detection for the $O_2$-sensor when the operation state of the internal combustion engine is stable.

With the arrangement described above, the abnormality detection accuracy can significantly be enhanced because the abnormality or fault detection of the $O_2$-sensor is performed in the state where the engine operation is stable with the $O_2$-sensor being adequately warmed up.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
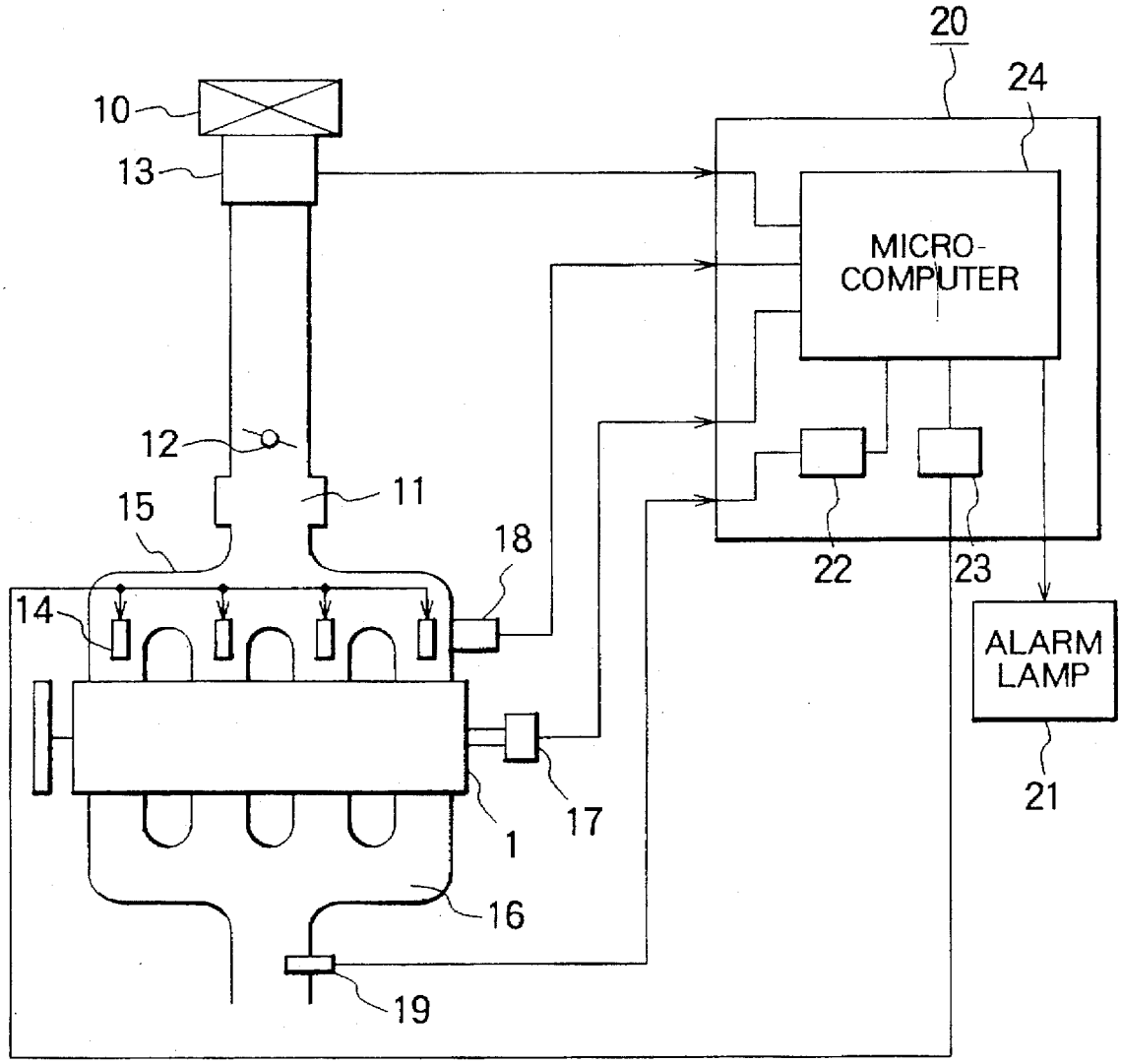
FIG. 1 is a block diagram showing a general arrangement of an internal combustion engine system equipped with a fuel supply control system which includes an $O_2$-sensor fault diagnosis apparatus according to an embodiment of the present invention.

Now, the present invention will be described in detail in conjunction with what is presently considered as preferred or typical embodiments thereof by reference to the drawings. In the following description, like reference characters designate like or corresponding parts throughout the several views.

FIG. 1 is a block diagram showing a general arrangement of an internal combustion engine system equipped with a fuel supply control system which includes an $O_2$-sensor fault diagnosis apparatus according to an embodiment of the present invention. Referring to the figure, an air-flow sensor 13 which is disposed within an intake pipe 15 at a location downstream of an air cleaner 10 is designed to generate a pulse signal having a duty cycle which depends on the amount of air fed to an engine 1, wherein the pulse signal is supplied to an electronically controlled fuel injection unit (hereinafter referred to as the ECU in abbreviation) 20. A crank angle sensor 17 provided in association with a crank shaft of the engine 1 generates a pulse signal including a number of pulse which corresponds to the rotation speed (rpm) of the engine 1. This pulse signal is also supplied to the ECU 20.

Further, the ECU 20 has inputs for receiving an output signal of a water temperature sensor 18, an output signal of an $O_2$-sensor 19 for detecting concentration of oxide ($O_2$) contained in the exhaust gas of the engine and an output signal of the crank angle sensor 17, respectively, to thereby control the fuel injectors 14 provided for the individual cylinders, respectively, of the engine 1. Accordingly, the ECU 20 serves also for detection of deterioration of the $O_2$-sensor 19 and a fault thereof, wherein a signal indicative of the result of the detection is generated for activating an alarm lamp 21 to inform an operator or driver of the deterioration or fault of the $O_2$-sensor by activating the alarm lamp 21. Incidentally, it should also be mentioned that a throttle valve 12 and a surge tank 11 are disposed in the intake pipe 15 at positions downstream of the air-flow sensor 13 as viewed in the direction of the intake air flow.

Figure 2:
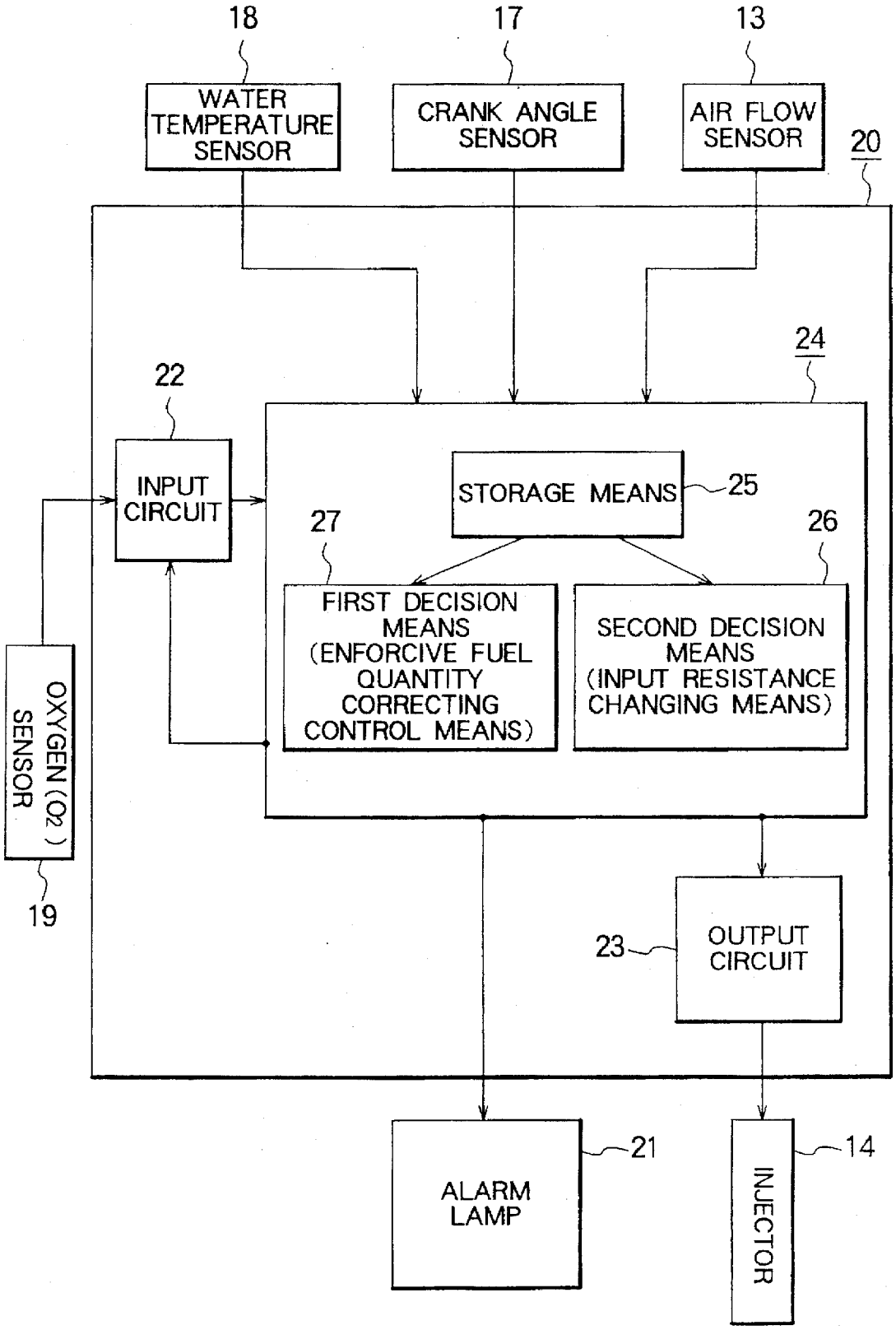
FIG. 2 is a block diagram showing a structure of the $O_2$-sensor fault diagnosis apparatus according to the instant embodiment of the present invention.

FIG. 2 is a block diagram showing a structure of the $O_2$-sensor fault diagnosis apparatus according to the instant embodiment of the present invention. The ECU 20 constituting the $O_2$-sensor fault diagnosis apparatus is composed of a microcomputer 24 designed or programmed to determine arithmetically an optimal amount of fuel to be supplied to the engine on the basis of the output signals of the water temperature sensor 18, the $O_2$-sensor 19 and the crank angle sensor 17, respectively. The ECU 20 converts the fuel amount as determined into a fuel injector driving time duration. The ECU also outputs to the alarm lamp 21 a detection signal indicative of a fault of the $O_2$-sensor 19. The output circuit 23 receives signals from ECU 20 and outputs a pulse signal having a duty ratio proportional to the injector driving time duration to the fuel injector 14. Input circuit 22 inputs the output signal of the $O_2$-sensor 19 to the microcomputer 24 by changing over the signal level.

Furthermore, the microcomputer 24 includes a storage means 25 for storing data derived from the output signals of the air-flow sensor 13, the crank angle sensor 17, the water temperature sensor 18 and the $O_2$-sensor. Input resistance changing means 26 serves as a second decision means for making decision as to a fault of the $O_2$-sensor on the basis of the output signals obtained from the $O_2$-sensor 19 during a period in which input resistance of the input circuit 22 is enforcive fuel quantity correcting control means 27 constitutes a first decision means for correcting forcibly the amount or quantity of fuel to be supplied to the engine to thereby make decision as to occurrence of a fault in the $O_2$-sensor 19 on the basis of the $O_2$-sensor 19 during a period of enforcive fuel quantity correcting control.

The output signal data of the $O_2$-sensor 19 derived via the input circuit 22 and the output signals of the individual sensors stored in the storage means 25 are transferred to the enforcive fuel quantity correcting control means 27 serving as the first decision means and the input resistance changing means 26 constituting the second decision means.

The enforcive fuel quantity correcting control means 27 determines the timing for effectuating the enforcive fuel quantity correcting control to thereby correct or change forcibly the fuel quantity (i.e., amount of the fuel) to be supplied to the engine at the timing as determined, wherein the output signal level generated by the $O_2$-sensor 19 during the enforcive fuel quantity correcting control period is made use of by the first decision means in the decision as to presence or absence of a fault in the $O_2$-sensor.

On the other hand, the input resistance changing means 26 arithmetically determines the timing for changing the input resistance to thereby vary the input resistance for a predetermined temporal period at the timing as determined, wherein the output of the $O_2$-sensor 19 during this period is made use of in the decision performed by the second decision means.

In this way, the first decision means decides whether the $O_2$-sensor 19 suffers a fault on the basis of the output signal level of the $O_2$-sensor 19 controlled by the enforcive fuel quantity correcting control means 27, while the second decision means decides absence or presence of a fault in the $O_2$-sensor 19 on the basis of the output signal level generated by the $O_2$-sensor 19 during operation of the input resistance changing means 26. When a fault of the $O_2$-sensor 19 is decided by either one of the first and second decision means, the alarm lamp 21 is lit.

At this juncture, it should be mentioned that the input circuit 22 can be implemented simply by addition of inexpensive parts and/or simple alteration of a configuration of the input circuit for the $O_2$-sensor 19 which circuit is known heretofore.

Figure 6:
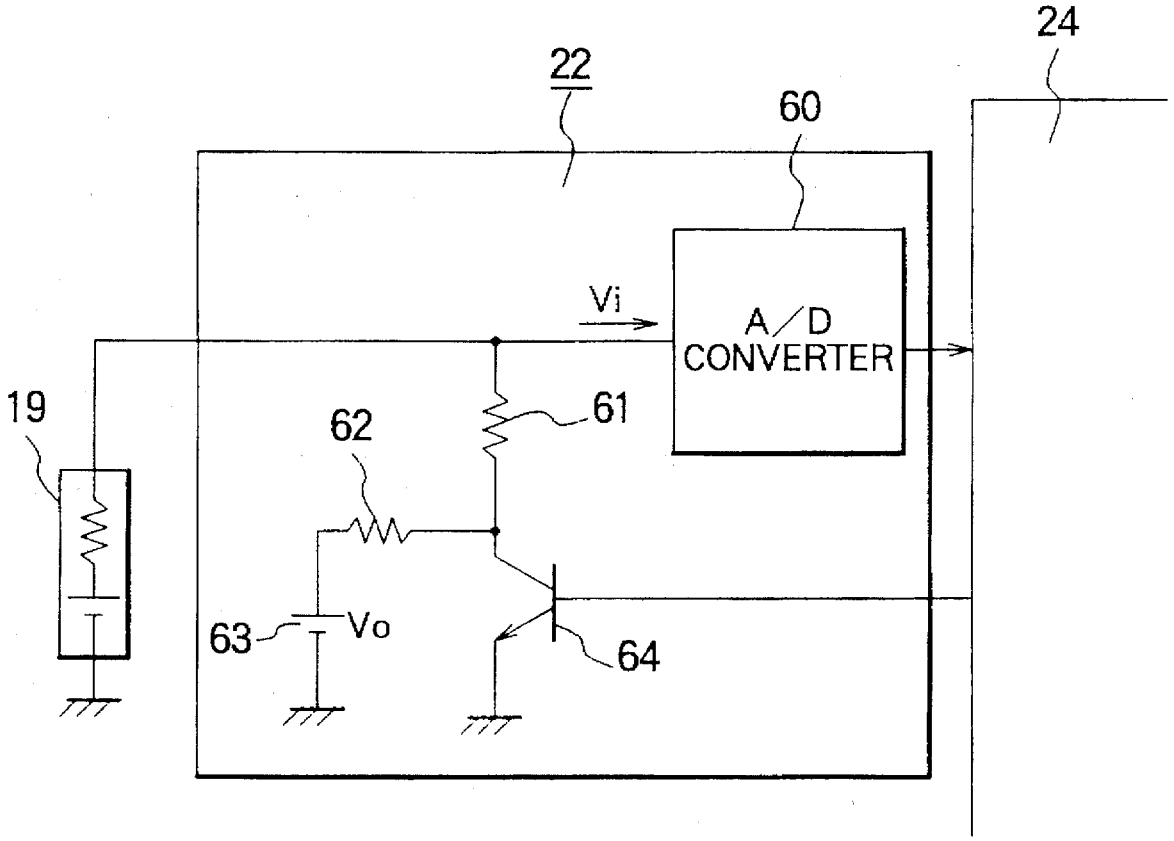
FIG. 6 shows, by way of example, a configuration of an input circuit which receives an output signal of an $O_2$-sensor.

FIG. 6 shows, by way of example, a configuration of the input circuit 22. As can be seen in the figure, the input circuit 22 is constituted by an analogue-to-digital converter (hereinafter referred to as the A/D converter) 60 having an input terminal connected to an output terminal of the $O_2$-sensor 19, a resistor 61 connected to the input terminal of the A/D converter 60, a transistor 64 serving as a switching element and connected between the other end of the resistor 61 and the ground potential, wherein a junction between the resistor 61 and the collector of the transistor 64 is connected to the ground potential by way of a resistor 62 and a voltage source 63. The transistor 64 has a base to which an ON/OFF control signal is applied from the microcomputer 24 incorporating the input resistance changing means 26 (see FIG. 2), whereby the input resistance of the $O_2$-sensor 19 presented to the A/D converter 60 is changed.

Ordinarily, when the output signal of the $O_2$-sensor 19 is inputted to the microcomputer 24 by way of the input circuit 22, the transistor 64 is turned on (set to the conducting state), as a result of which the output of the $O_2$-sensor 19 is connected to the ground potential by means of the resistor 61. Since the value of the resistor 61 is set to be sufficiently large for the input impedance of the $O_2$-sensor 19, the output voltage of the $O_2$-sensor 19 is inputted intact to the A/D converter 60.

During the timing for the input resistance change for validating the fault decision of the $O_2$-sensor 19, the transistor 64 is turned off, which results in that one end of the resistor 61 is connected to the voltage source 63 via the resistor 62. In that case, when a wire fault takes place in the output line of the $O_2$-sensor 19, the input voltage Vi of the A/D converter 60 assumes the level of the source voltage Vo of the voltage source 63. On the other hand, when a ground-fault occurs in the output line of the $O_2$-sensor 19, the input voltage Vi of the A/C converter 60 assumes ground potential level. By detecting the changes in the level of the input voltage Vi mentioned above, it is possible to identify discriminatively the fault of the $O_2$-sensor 19.

However, when the temperature of the $O_2$-sensor is low as in the state where engine operation is stopped, the $O_2$-sensor 19 exhibits characteristically a large internal resistance value. As a result of this, the internal resistance of the $O_2$-sensor 19 assumes a considerably large value relative to that of the combined resistance of the resistors 61 and 62. Consequently, the input voltage Vi to the A/D converter 60 is at a level substantially coinciding with the source voltage Vo of the voltage source 63, which makes it practically impossible to make the aforementioned decision with reasonable accuracy. Such being the circumstances, the fault decision is usually executed in the state where the $O_2$-sensor 19 is warmed up sufficiently for allowing the internal resistance value of the $O_2$-sensor 19 to assume an adequately small value.

As can be appreciated from the foregoing, when abnormality occurs in the $O_2$-sensor 19, the output signal level of the $O_2$-sensor 19 assumes a level which can never be expected so long as the $O_2$-sensor 19 is sound. Thus, the fault decision can be realized with a high reliability. Additionally, when the input resistance is changed even only once after the start of the engine operation, there exists no need for changing the input resistance. Thus, there can be obtained an advantage that the ordinary feedback control is effected without encountering any obstacle after completion of the fault decision performed with the aid of the input resistance changing means 26.

Figure 3:
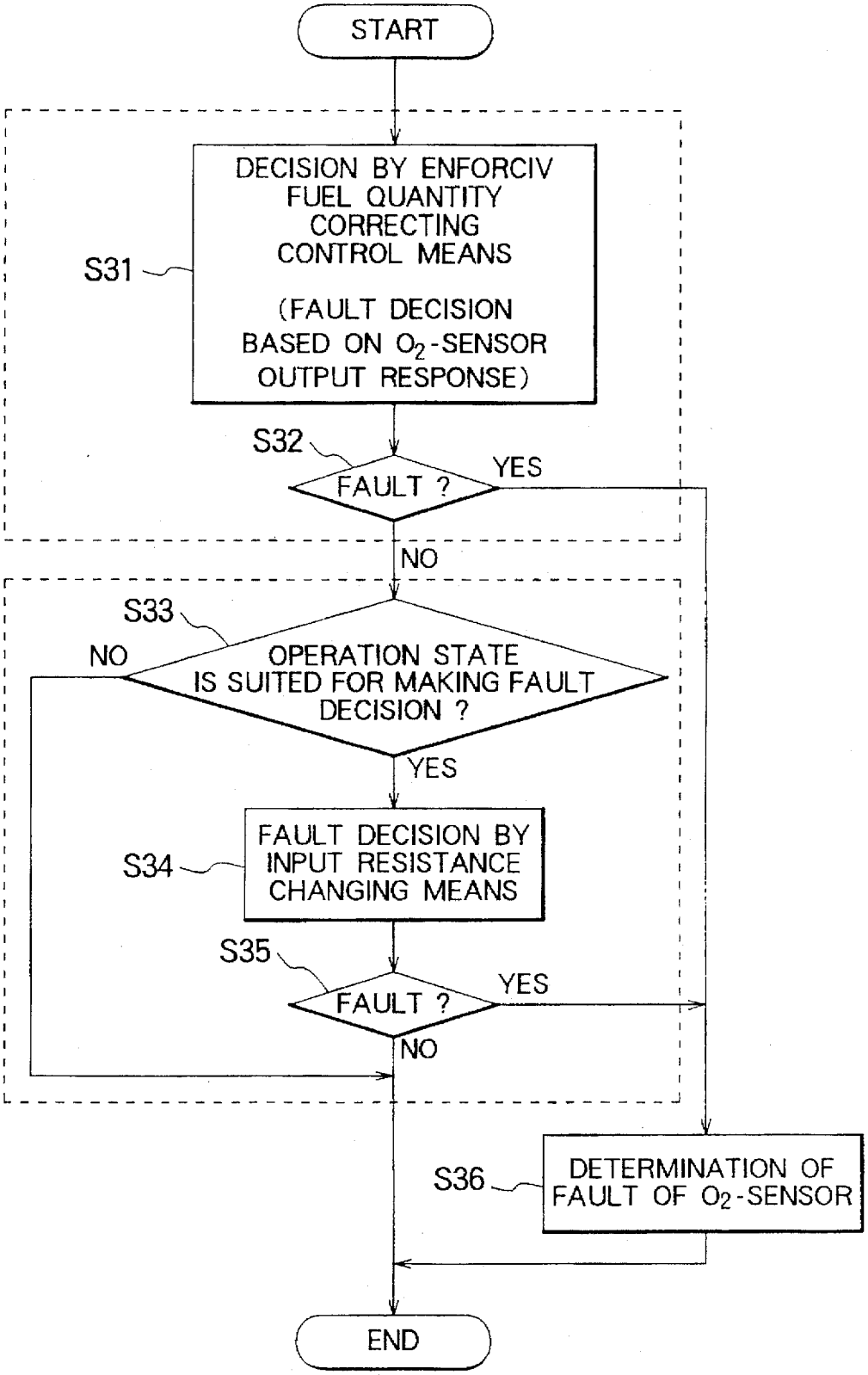
FIG. 3 is a flow chart for illustrating in general a flow of the $O_2$-sensor fault decision procedure.

Next, operation of the $O_2$-sensor diagnosis according to the instant embodiment of the invention will be described by reference to flow charts shown in FIGS. 3 to 5, wherein FIG. 3 is a flow chart for illustrating a general feature of the $O_2$-sensor fault decision procedure.

Referring to FIG. 3, the first decision means 27 corrects or varies forcibly the fuel amount or quantity supplied to the engine to thereby fetch the output signal of the $O_2$-sensor 19 during the enforcive fuel quantity correcting control period (step S31). Subsequently, in a step S32, decision is made as to occurrence of a fault in the $O_2$-sensor 19 on the basis of the level of the output signal thereof.

Unless the fault is detected by the first decision means 27, the second decision means 26 determines whether the operation state optimal for making the fault decision has been attained, in which the internal resistance value of the $O_2$-sensor 19 assumes a sufficiently small value relative to that of the resistor 61 (i.e., determination of the timing for the fault decision) in a step S33. Unless the optimal state has been reached, the fault decision processing is terminated.

On the other hand, when it is decided in the step S33 that the engine operation state favorable to the fault decision has been attained, the input resistance of the input circuit 22 which receives the output signal from the $O_2$-sensor 19 is changed to thereby fetch the output signal of the $O_2$-sensor 19 (step S34). When it is decided that the output signal level of the $O_2$-sensor 19 is deviated significantly from the normal level, it is then decided that the $O_2$-sensor 19 suffers a fault (step S35). Of course, unless the output signal level indicates abnormality, the fault decision processing is terminated. In this conjunction, such arrangement may be adopted that the first decision means 27 is validated when the feedback control is performed for the fuel supply, while the second decision means 26 is brought into operation in the state where the feedback control is not performed. Alternatively, such arrangement may equally be adopted that when the first decision means fails to make the decision as to abnormality of the $O_2$-sensor 19, then the second decision means is activated.

Figure 4:
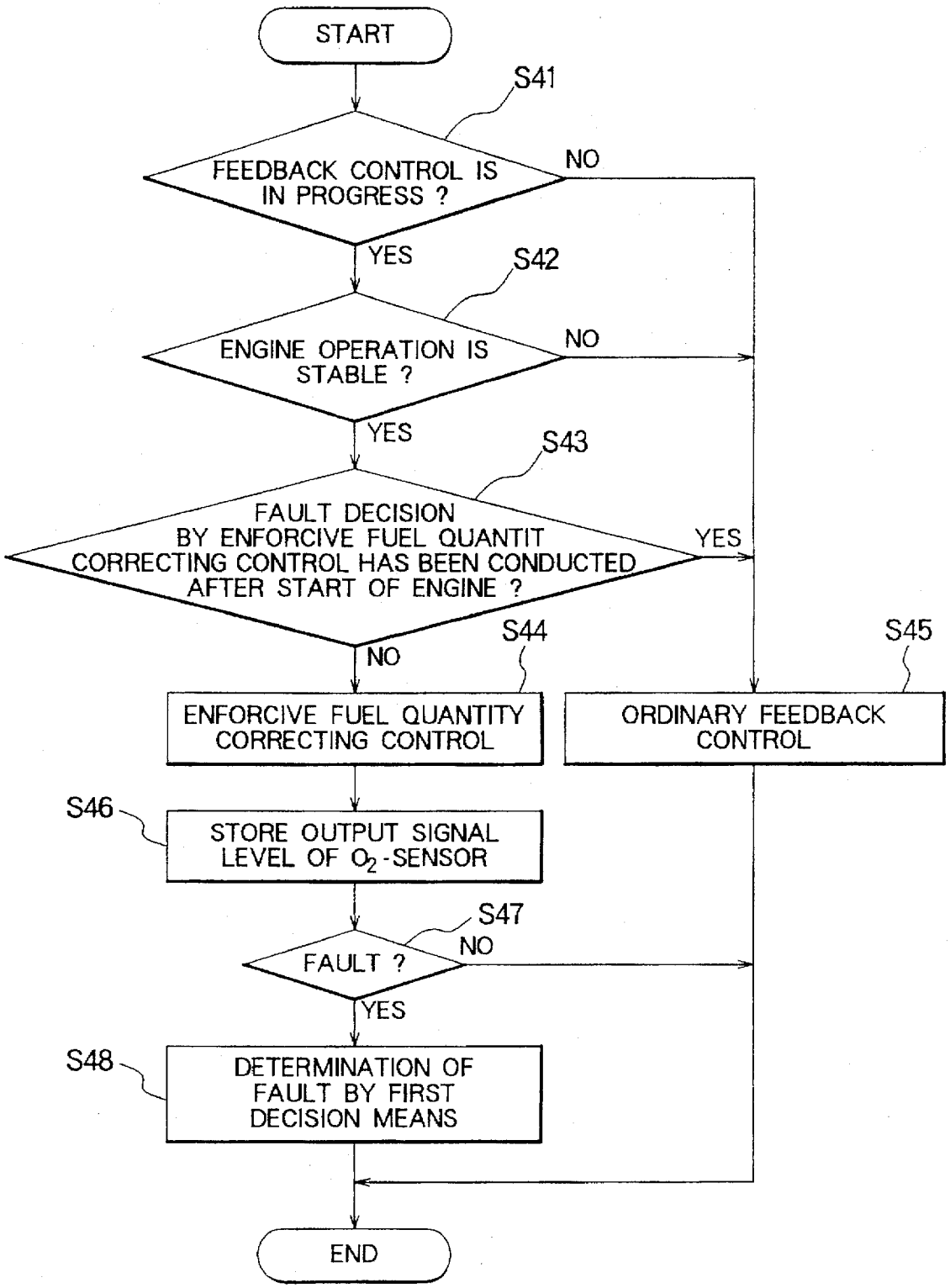
FIG. 4 is a flow chart for elucidating a fault decision processing executed by a first decision means.

Next, the fault decision processing executed by the first decision means 27 will be elucidated in detail by reference to FIG. 4.

Referring to FIG. 4, it is decided in a step S41 whether the feedback control is being carried out. When this decision step 41 results in negation "NO", the processing now under consideration comes to an end. In contrast, when the feedback control is in progress, decision is made in a step S42 whether or not the engine operation as well as loads imposed to the engine are in a stable state. When the answer of this decision step S42 is negative "NO", the ordinary feedback control is performed in continuation.

On the other hand, when it is decided in the step S42 that the engine operation and the load state are stable, then the processing proceeds to a step S43 to check whether the enforcive fuel quantity correcting control has been previously performed even once. If so, the ordinary feedback control is performed, while if otherwise, the processing proceeds to a step S44 where the enforcive fuel quantity correcting control is performed, whereupon the processing comes to an end. With the enforcive fuel quantity correcting control, it is intended to mean a method of deciding occurrence of a fault in the $O_2$-sensor 19 in the state where both the engine operation and the engine load are stable by monitoring the output signal level of the $O_2$-sensor or response performance by varying forcibly toward richness or leanness from the stoichiometric air-fuel ratio the amount or quantity of fuel injected to the engine for a predetermined period.

The output signal level of the $O_2$-sensor 19 during the enforcive fuel quantity correcting control is fetched by the microcomputer to be stored in an associated memory in a step S46 to be made use of in making the fault decision by the first decision means. More specifically, the first decision means makes decision as to occurrence of a fault in the $O_2$-sensor on the basis of the output signal level thereof by reading out the stored data from the memory in the step S47. When a fault of the $O_2$-sensor or abnormality thereof is decided, the result of the decision performed by the first decision means is stored in a memory incorporated in the microcomputer.

Figure 5:
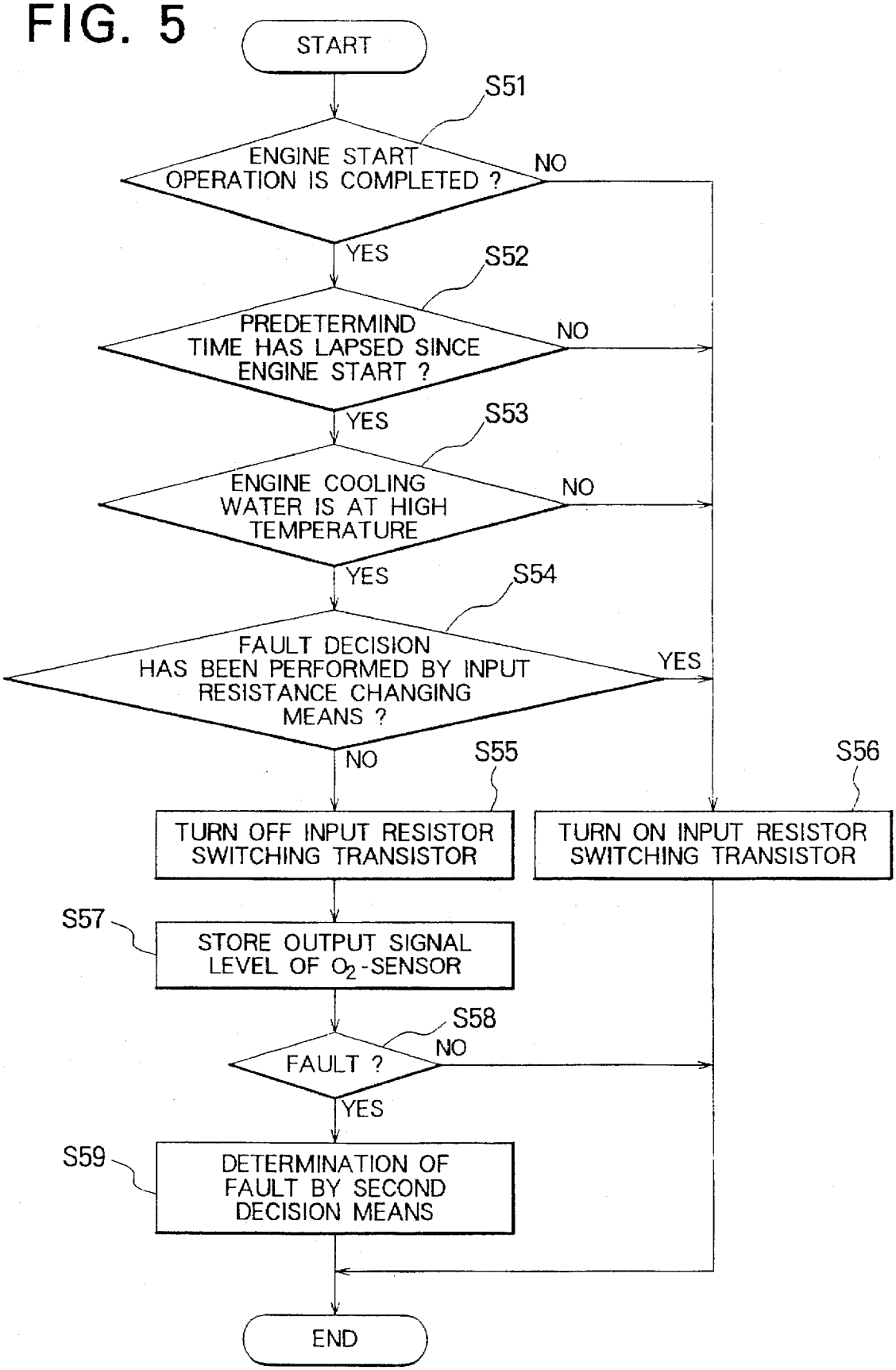
FIG. 5 is a flow chart for elucidating a fault decision processing executed by a second decision means.

Next, fault decision procedure executed by the second decision means will be elucidated by reference to a flow chart of FIG. 5.

The fault decision processing now under consideration is performed for realizing the method of changing the input resistance value of the input circuit receiving the output signal from the $O_2$-sensor, which method is carried out in the state where the $O_2$-sensor 19 is sufficiently warmed up after lapse of a predetermined time from the start of the engine operation. Accordingly, in a step S51, it is decided whether the engine operation has been started or not. When the decision step S51 results in affirmation "YES", indicating that the engine 1 is operating, it is then decided in a step S52 whether a predetermined time has lapsed from the start of the engine operation. When the answer of the decision step S51 is affirmative "YES", then the processing proceeds to a step S53 for deciding whether the temperature of the engine cooling is higher than a predetermined level.

When it is decided that the temperature of the engine cooling water is higher than the predetermined level, then decision is made as to whether the fault decision based on the change of the input resistance has been performed at least once. If not, the processing proceeds to a step S55 where the transistor 64 is turned off by the second decision means 26 for a predetermined period. The output signal level of the $O_2$-sensor 19 during this period is stored in a memory incorporated in the microcomputer to be used for the decision performed by the second decision means.

On the other hand, when the conditions in the steps S51 to S54 are not fulfilled (i.e., when the engine is in the stalling or starting operation phase, when the aforementioned predetermined time has not lapsed since the start of the engine operation, when the temperature of the engine cooling water is short of the predetermined water temperature and/or when the fault decision has already been executed), the transistor 64 is turned on in a step S56, to thereby allow the ordinary input circuit state for the $O_2$-sensor 19 to be maintained.

In a step S58, decision is made as to occurrence of abnormality in the $O_2$-sensor on the basis of the output signal level thereof by reading out the stored data in the step S57. When decision is made that the $O_2$-sensor 19 suffers abnormality, the result of execution of the processing in the step S59 performed by the second fault decision is stored in a memory of the microcomputer.

When either one of the fault decision results performed by the first decision means and second decision means indicates occurrence of a fault or abnormality in the $O_2$-sensor 19, the alarm lamp 21 is lit (i.e., electrically energized)..

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, although it has been described that the second decision means is arranged to determine wire braking/ground-fault of the $O_2$-sensor 19, the invention is never limited to detection of the such particular abnormality. However, any other suitable decision means exhibiting a stronger correlation relative to the abnormality than the first decision means, e.g. a means adapted for detecting that the output signal of the $O_2$-sensor does not change in the operation range in which the feedback control is performed. Besides, the detection of no generation of the output signal from the $O_2$-sensor in an enrich zone usually corresponding to the high load zone may be detected.

Accordingly, all suitable modifications and equivalents may be resorted to, falling within the spirit and scope of the invention.

What is claimed is:

1. A fault diagnosis apparatus for an $O_2$-sensor employed in a fuel supply control system of an internal combustion engine, comprising:

an $O_2$-sensor for detecting concentration of oxygen contained in an exhaust gas of an internal combustion engine;

feedback control means for controlling a quantity of fuel supplied to said internal combustion engine through feedback control in dependence on an output signal of said $O_2$-sensor; and a microcomputer;

wherein said microcomputer is preprogrammed to perform;

a first means comprising an enforcive fuel quantity correcting control circuit for computing if said $O_2$-sensor exhibits an abnormality on the basis of the output signal state of said $O_2$-sensor for forcibly changing the amount of said fuel supplied to the engine during said feedback control; and a second computation means comprising an input resistance changing circuit for detecting an abnormality of said $O_2$-sensor in accordance with an abnormality computation process which bears a stronger correlation to the abnormality than the commutation performed by said first computation means, said second computation being performed when said feedback control based on the output of said $O_2$-sensor is not being performed.

2. An $O_2$-sensor fault diagnosis apparatus according to claim 1, wherein said input resistance changing circuit charges an input resistance for said $O_2$-sensor feedback control means.

3. An $O_2$-sensor fault diagnosis apparatus according to claim 2, wherein said input resistance changing means includes an input circuit disposed between output of said $O_2$-sensor and said microcomputer, said input circuit including:

an analogue-to-digital converter having an input connected to the output of said $O_2$-sensor and an output connected to an input port of said microcomputer;

an input resistor connected to an input terminal of said analogue-to-digital converter;

a switching element connected between the other end of said input resistor and the ground potential, wherein a junction between said input resistor and said switching element is connected to the ground potential by way of a resistor and a voltage source, and wherein an ON/OFF control signal is applied from said microcomputer to said switching element to thereby correspondingly change resistance of said input circuit.

4. An $O_2$-sensor fault diagnosis apparatus according to claim 2, wherein said input resistance changing mean presents a high input resistance to said $O_2$-sensor feedback control means when the feedback control is being performed, and applies a predetermined voltage to one end of an input resistor for said feedback control means upon decision of abnormality.

5. A fault diagnosis method for an $O_2$-sensor employed in a fuel supply control system of an internal combustion engine, comprising:

a first operation of forcibly varying an amount of fuel supplied to said internal combustion engine during a feedback control of the fuel supply to said engine in dependence upon an output signal supplied from an $O_2$-sensor for detecting concentration of oxygen contained in an exhaust gas of an internal combustion engine, to thereby compute if said $O_2$-sensor suffers an abnormality on the basis of an output signal state of said $O_2$-sensor; and a second operation of computing if an abnormality of the $O_2$-sensor exists in accordance with a second computation method which bears a stronger correlation to the abnormality of the $O_2$-sensor when the feedback control of the fuel supply to the engine is not performed.

6. An $O_2$-sensor fault diagnosis method according to claim 5, wherein a voltage signal having different levels in dependence on ground-fault or wire breaking of an output line of said $O_2$-sensor is generated for the feedback loop.

7. An $O_2$-sensor fault diagnosis method according to claim 5, wherein the abnormality detection for said $O_2$-sensor is effectuated when the operation state of said internal combustion engine is stable.

* * * * *